United States Patent [19]

Takenoya et al.

[11] 4,289,084

[45] Sep. 15, 1981

[54] SEWING MACHINE WITH STITCH TYPE IDENTIFYING DEVICE

[75] Inventors: Hideaki Takenoya; Yoshinobu Tonomura, both of Hachioji, Japan

[73] Assignee: Janome Sewing Machine Co., Ltd., Tokyo, Japan

[21] Appl. No.: 48,434

[22] Filed: Jun. 14, 1979

[30] Foreign Application Priority Data

Jun. 15, 1978 [JP] Japan ..... 53-71518

[51] Int. Cl.[3] ..... D05B 3/02; D05B 29/00

[52] U.S. Cl. ..... 112/158 E; 112/235

[58] Field of Search ..... 112/158 E, 158 R, 235, 112/240, 260, 121.11, 275, 277

[56] References Cited

U.S. PATENT DOCUMENTS

| | | | |
|---|---|---|---|
| 3,131,660 | 5/1964 | Idomoto | 112/260 |
| 3,926,133 | 12/1975 | Herron et al. | 112/158 R |
| 4,056,070 | 11/1977 | Hauf | 112/235 X |
| 4,079,683 | 3/1978 | Hanyu et al. | 112/240 X |
| 4,166,423 | 9/1979 | Brienza et al. | 112/158 E X |

*Primary Examiner*—Peter P. Nerbun

*Attorney, Agent, or Firm*—Michael J. Striker

[57] ABSTRACT

A sewing machine can accept a plurality of presser feet for specific stitching applications. The invention adjusts lateral movement of the needle, feed dog operation, and needle hole size at the needle plate to conform with the presser foot used, and to thereby prevent needle breakage and skipped stitches.

14 Claims, 7 Drawing Figures

11: Pattern Selecting Button
12: Pattern Indicating Lamp
13: Needle Swing Control Pulse Motor
14: Feed Amount Control Pulse Motor
15: Solenoid For Straight Stitching
16: Solenoid For Dropping Feed Dog
1 : Hall IC For Straight Stitching
1A: Hall IC For Dropping Feed Dog
25: Magnet
95: Magnet

SEWING MACHINE WITH STITCH TYPE IDENTIFYING DEVICE

BACKGROUND OF THE INVENTION

Various kinds of stitches can be produced by a modern sewing machine, but it is necessary to carefully adjust the parts of the machine to correspond with the stitches to be made. For example, a zigzag stitch requires a lateral movement of the machine needle in addition to a vertical movement, and the needle requires adjustment from its maximum lateral amplitude for zigzag stitches to a zero amplitude for straight stiches. In this type of sewing machine, the needle hole in a needle plate and a corresponding hole in the presser foot are in general laterally elongated to meet the maximum amplitude required by a zigzag stitch. When the needle drops into the centers of these holes, stitches are often skipped, particularly when straight stitching such difficult materials as tricot, crepe de Chine and the like, since the needle holes are large and the effect of the presser foot is weak in their centers. In modern machines, such skipped stitches are eliminated by a mechanism which reduces the laterllay elongated needle hole of the needle plate to a small circular hole for straight or chain stitches, and this mechanism must be manually operated to correspond to the stitch type desired. Additionally, a straight stitch presser foot must be installed in order to press the part of the cloth nearest the needle. However, the machine operator often forgets such operations. For example, if the presser foot is changed for the straight stitch, the lateral movement mechanism for the needle may not be readjusted out of the zigzag setting. Here, when the sewing machine is driven, the needle will move laterally, onto a surface of the presser foot, and will break. If, on the other hand, the presser foot is changed for zigzag stitches, the needle hole in the needle plate may still be set for straight stitches and the needle will again be dropped onto a surface of the needle plate, and will likewise break.

SUMMARY OF THE INVENTION

The present invention has been devised to eliminate such defects and disadvantages of the prior art. It is a primary object of the invention to provide a sewing machine which is automatically set and adjusted for producing a desired stitch type when a presser foot for that type of stitch is installed.

This object is achieved by the use of magnets which are embedded in the various presser feet which can be attached to the presser bar, which magnets cooperate with appropriate sensors located beneath the needle plate. The sensors are so located that the electrical signals they produce indicate the type of foot attached.

These signals are then used in an electronic control system which causes appropriate mechanical devices to operate, thereby adjusting the needle mechanism, the hole in the needle plate, and the feed dog to operate consistently with the type of presser foot used. In this fashion, needle breakage and skipped stitches are accordingly avoided.

The other features and advantages of the invention will be apparent from the following description of the invention in reference to the preferred embodiments as shown in the attached drawings.

DETAILED DESCRIPTION OF PREFERRED EMBODIMENTS

Figure 1:
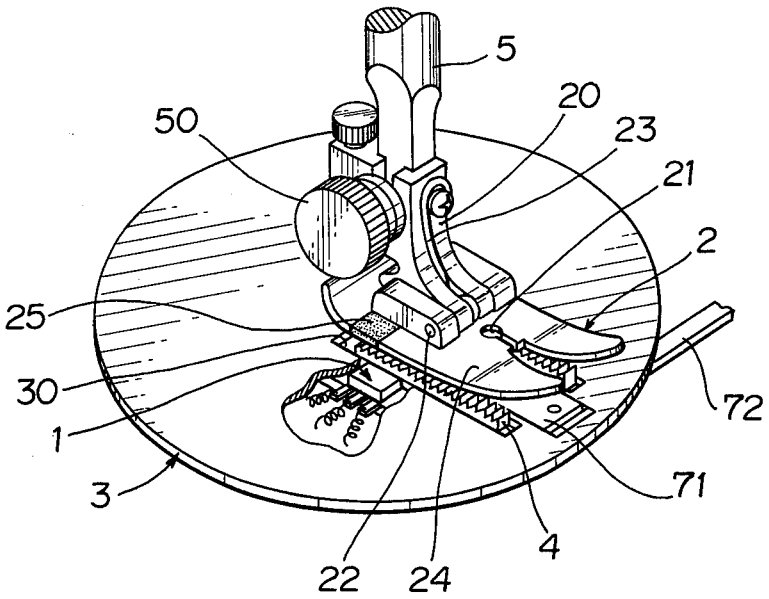
FIG. 1 is a perspective view showing a combination of a presser foot and a needle plate incorporating the invention.

Referring to FIGS. 1–4, reference numerals 1 and 1A show magnetic flux detectors provided on the underside of a needle plate 3 on both side of the openings 30, 30 which openings accomodate a feed dog 4 which is disposed in machine housing 18. FIG. 1 shows a presser foot 2 mounted on a presser bar 5 and raised above the needle plate 3. The presser foot 2 is of a type used for straight stitching and is formed with a small circular hole 21 into which a needle may drop. This presser foot 2 is pivotally attached to holder 20 by a pin 22, and biased downwardly by a spring bar 23. The holder 20 is detachably secured to the lower end of the presser bar 5 by thumbscrew 50.

A magnet 25 is embedded in the expanded left side 24 of the presser foot 2. The magnet 25 will thus be located just above the flux detector 1 which is provided to the left of the openings 30, 30 on the underside of the needle plate 3. The flux detector 25 may be a Hall generator integrated circuit IC a reed switch or a magnetically variable resistance. The flux detectors and 1A are connected to an electronic control circuit 10 shown in FIG. 7, so that the detectors may generate a signal for use in the control circuit when a magnet is placed near them.

The signal from the flux detector 25 adjusts parts of the sewing machine in accordance with the presser foot actually used. If the presser foot 2 for straight stitching in FIG. 1 is used, the signal operates a switching mechanism 7 for narrowing the needle hole in the needle plate, and closes the oblong hole 31 (which is used for zigzag stitching) with a closing slide 71 leaving a small circular hole 70 which is used for straight stitching. If the presser foot 2 is taken off the presser bar 5, and another presser foot without the magnet (not shown) is substituted the control circuit 10 receives no input signal, and the needle hole 70 of the needle plate 3 is automatically widened to the oblong hole 31 in a process described later. Therefore, in this invention, the presser foot is provided with an embedded magnet for straight stitching and chain stitching, both requiring no lateral movement of the needle. On the other hand, the zigzag stitching presser foot is not provided with a magnet, since lateral movement of the needle is required.

Figure 2:
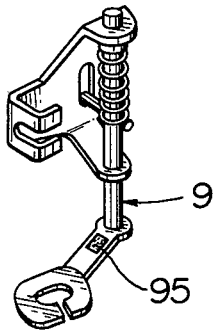
FIG. 2 is another perspective view showing a presser foot used with the invention.
Figure 3:
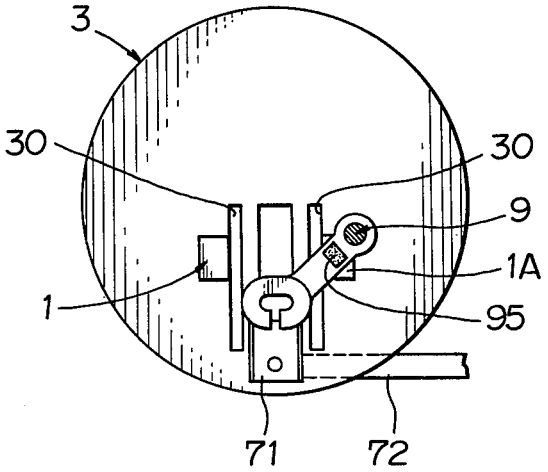
FIG. 3 is a plan view showing a combination of the presser foot shown in FIG. 2 and the needle plate.
Figure 6:
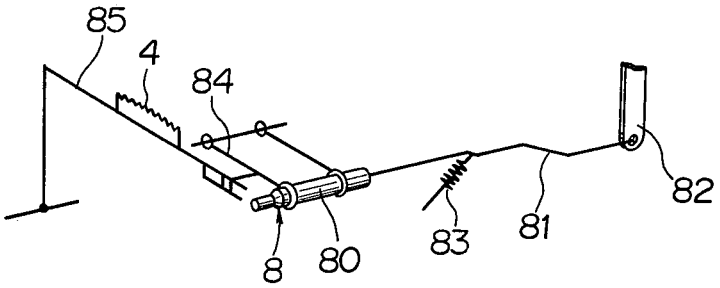
FIG. 6 is a perspective view showing another part of the invention.

The present invention can also automatically set the sewing machine for embroidery stitching by employing a suitable presser foot. In the embroidery stitching (which requires no cloth feed), it is necessary to drop the feed dog 4 below the level of the needle plate 3. For doing so, an embroidery stitching presser foot 9 as shown in FIG. 2 has a magnet 95 embedded therein so as to be located opposite the flux detector 1A on the right side of the feed dog opening 30 (as is shown in FIG. 3) when the presser foot 9 is attached to the presser bar 5. The signal issued from the detector 1A causes the control circuit 10 to operate the feed dog drop mechanism 8 shown in FIG. 6 so as to drop the feed dog 4 to an inoperative position below the needle plate 3. When the presser foot is detached, the signal disappears and the feed dog 4 is automatically returned its original operating position, since the signal has ceased. Therefore, an additional flux detecting element may be disposed at a different position on the needle plate 3 so that it may cooperate with another type of magnet equipped presser foot for another type of stitching.

Figure 4:
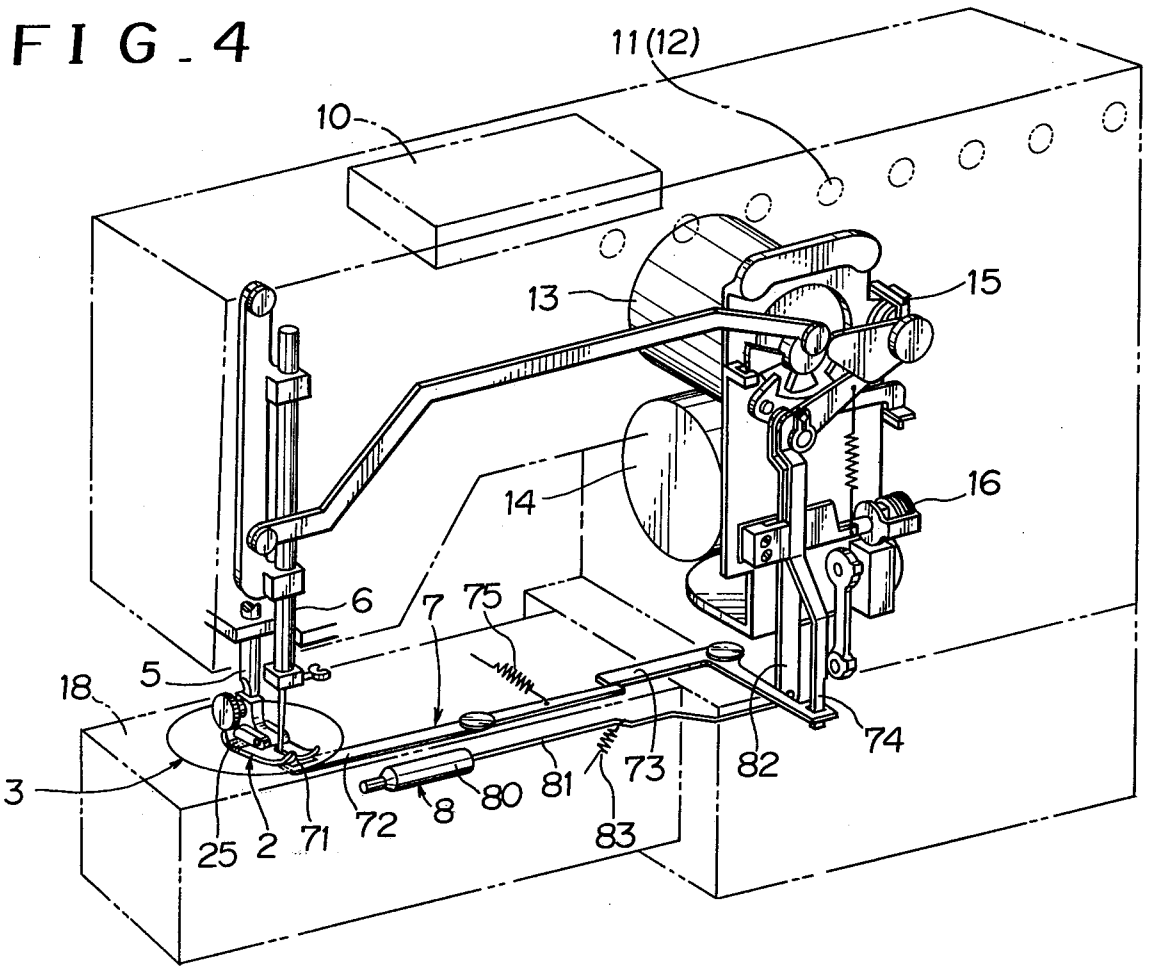
FIG. 4 is a perspective view showing various parts of a sewing machine construced according to the invention.
Figure 5:
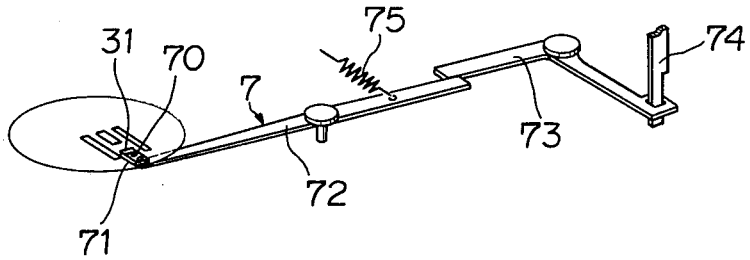
FIG. 5 is a perspective view showing a part of the invention.
Figure 7:
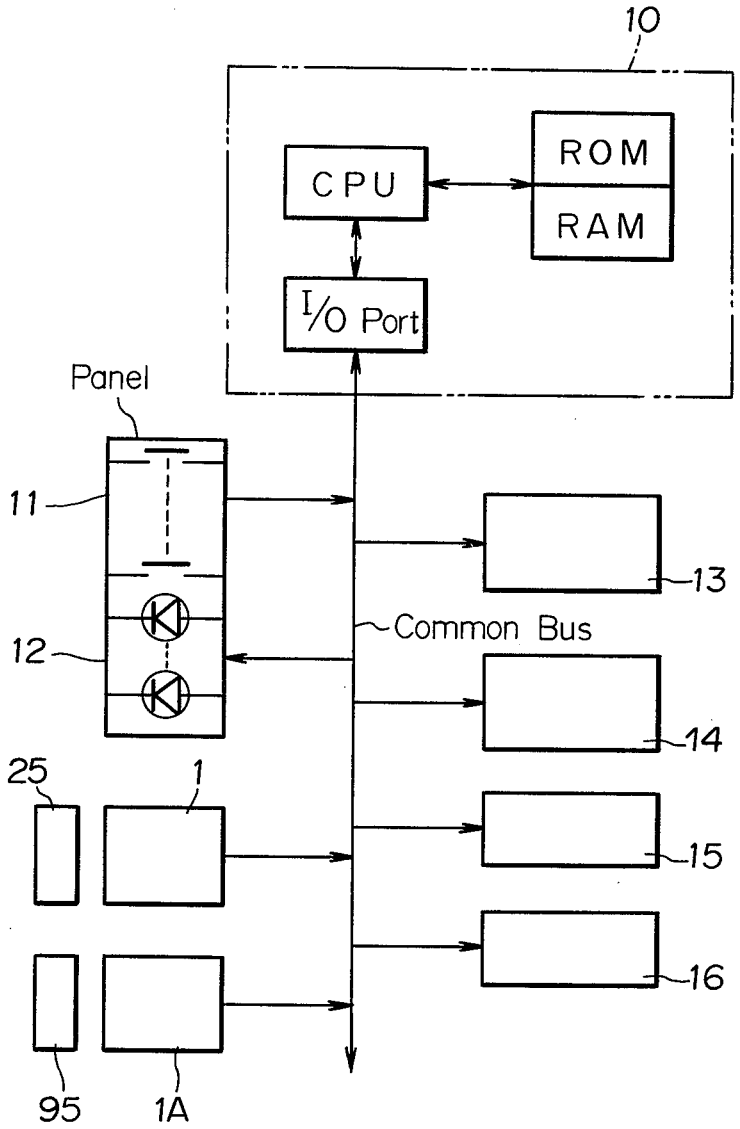
FIG. 7 is an operational block diagram of the control system used in the invention.

In FIGS. 4 and 7 a numeral 10 denotes a control circuit composed of a micro-computer including a central processing unit CPU, a read only memory ROM, a read-write memory RAM and an input and output port I/O. 11 denotes a pattern selecting button, 12 denotes a pattern indicating lamp, 13 denotes a pulse motor for the needle movement, 14 denotes a pulse motor for feeding, 15 denotes a solenoid for changing the size of the needle hole of the needle plate 3, 16 denotes a solenoid for dropping the feed dog 4, 7 denotes a device for changing the size of the needle hole in dependence upon the selected stitching type, and 8 denotes a device for actually dropping the feed dog 4 and returning it to its initial operating position.

The operation of such an electronic sewing machine is initiated by operating a pattern selecting switch and thereby selecting the stitch desired. The stitch type is then registered in the control circuit, the pattern indicating lamp is then lighted, and a suitable control output is finally produced. Subsequently, the stitch control pulse motors and a machine drive motor are temporarily driven to prepare the related mechanisms for the stitching type selected, and are stopped after the sewing machine has finally been set for producing the stitch type.

In this invention, if the presser foot 2 for straight and chain stitching is attached to the presser bar 5, the embedded magnet 25 is detected by the flux detector 1. The detector 1 provides a signal to the control circuit 10, which treats the signal and deenergizes the needle swing control pulse motor 13, and solenoid 15 is energized to turn a switching lever 74 counterclockwise, to thereby turn a lever 72 clockwise via an intermediate lever 73 against the pull of tension spring 75. As a result, a slide element 71, which is secured to the end of the operation lever 72 and has a small circular hole 70 for straight stitching, is advanced to close off the laterally elongated zigzag stitching hole 31 in the needle plate 3 and to substitute the small circular hole 70. When the presser foot 2 is detached, the solenoid 15 is deenergized, the slide element 71 is returned to the initial retired position by the action of the spring 75, and the needle hole 70 withdrawn to reinstate the laterally elongated hole 31.

If the embroidery stitching presser foot 9 is attached, the flux detector 1A detects the magnet 95 and provides a signal to control circuit 10, which treats the signal and deenergizes pulse motor 14. The feed dog drop solenoid 16 is energized to turn a feed dog drop lever 82 counterclockwise against pull of tension spring 83, to thereby pull the plunger 80 out of engagement with feed dog support structure 84 by means of connecting rod 81. As a result, the feed dog 4 is dropped to an inoperative position below the needle plate 3. When the presser foot 9 is detached, the solenoid 16 is deenergized, and the plunger 80 is reengaged with the feed dog support structure 84 by action of spring 83. As a result, the feed dog is again brought into its initial operating position.

Thus, in this invention, stitching types such as straight stitching, chain stitching, and embroidery stitching can only be changed by changing the presser foot, and selecting switches or buttons need not be provided for these stitches. Additional pattern selecting switches may be provided in the spare positions. Moreover, in this invention, additional manual setup operations are not required for these stitches and therefore a source of operational errors is thus eliminated. It will be easily conceived that this invention may be applied for selecting other patterns.

We claim:

1. In a sewing machine which can produce zigzag stitches using a laterally moving reciprocating needle and a needle plate having an elongated hole into which the needle may be dropped, which can further produce straight stitches using a laterally stationary reciprocating needle and a needle plate having a circular hole into which the needle may be dropped, and which can still further produce embroidery stitches by deactivating a feed dog, and which can accept a plurality of presser feet which are each adapted to a specific stitching application such as zigzag stitching, straight stitching and embroidery stitching, an improvement comprising: a first means attached to the sewing machine and cooperating with the presser foot attached thereto and producing a presser foot signal, the first means operating in a manner that the presser foot signal produced by the first means is determined by the presser foot which is attached to the machine; a lateral control means attached to the machine and cooperating with the needle to control lateral movement thereof in response to a lateral movement controlsignal; a needle plate adjusting means moving a plate bearing a circular hole to and from a position in which the circular hole is centrally located in the elongated hole in response to a needle plate signal; a feed dog means cooperating with the feed dog, the feed dog means activating and deactivating the feed dog in response to a feed dog signal; and a control circuit connected to the first means and responding to the presser foot signal, the control circuit operating in a manner that when a presser foot is attached to the machine, an appropriate lateral movement control signal, an appropriate needle plate signal and an appropriate feed dog signal are generated, whereby lateral needle movement, needle plate hole shape and feed dog operation are made consistant with the presser foot employed.

2. The improvement defined by claim 1, wherein the first means includes at least one flux detector attached to the machine and responsive to a magnet embedded in a presser foot.

3. The improvement defined by claim 2, wherein each flux detector is a Hall generator integrated circuit.

4. The improvement defined by claim 2, wherein each flux detector is a reed switch.

5. The improvement defined by claim 2, wherein each flux detector is a magnetically variable resistance.

6. The improvement defined by claim 1, wherein the needle plate adjusting means and the feed dog means are solenoid-operated.

7. The improvement defined by claim 1, wherein the control circuit includes a micro-computer.

8. A sewing machine comprising a machine housing, a needle bar with a needle mounted on the machine housing for vertical and laterally reciprocated movement, a feeding device including a feed dog and operated in a timed relation with the needle bar, a needle plate fixedly mounted on the machine housing and provided with a laterally elongated needle dropping hole, a presser device including a presser bar and a presser foot which is detachably mounted on the lower end of the presser bar for pressing a sewn work against the needle plate, drive means for controlling the lateral reciprocated movement of the needle bar, transmission means connected between the drive means and the needle bar, and transmitting the movement of the former to the latter, a slide element provided with a small circular hole through which the needle passes, and forming a part of the needle plate and slideable relative to the laterally elongated hole of the needle plate, actuating means for influencing the function of the slide element, magnet means embedded in the presser foot, detecting means embedded in the needle plate and detecting the magnet flux of the magnet to generate a signal, a control circuit receiving the signal from the detecting means and treating the same and then generating a control output, thereby to make the drive means inoperative and simultaneously energize the actuating means to move the slide element into the laterally elongated hole, whereby the laterally elongated hole is closed by the slide element except for a hole corresponding to the small circular hole of the slide element.

9. A sewing machine as defined in claim 8, further comprising transmission means connected between the actuating means and the slide element said transmission means comprising a combination of levers.

10. A sewing machine as defined in claim 8, wherein the actuating means comprises a solenoid which is deenergized upon detachment of the presser foot to allow the slide element to return the initial inoperative position from the position thereof located in the laterally elongated hole.

11. A sewing machine as defined in claim 8, wherein the actuating means is operatively connected to the feed dog and is energized to move the feed dog to an inoperative position below the needle plate.

12. A sewing machine as defined in claim 11, wherein the actuating means is deenergized upon detachment of the presser foot to allow the feed dog to return to the initial operative position.

13. A sewing machine as defined in claim 8, wherein the detecting means comprises a Hall IC, a lead switch or a magnet flux resistive element.

14. A sewing machine as defined in claim 8, wherein the magnet means is embedded in the sole of the presser foot opposite to the upper face of the needle plate, and the detecting means is embedded in the needle plate in the region thereof opposite to a part of the sole of the presser foot in which the magnet is located.

* * * * *